United States Patent [19]

Ogata et al.

[11] Patent Number: 4,788,570

[45] Date of Patent: Nov. 29, 1988

[54] THIN FILM DEVELOPING DEVICE

[75] Inventors: Yoshihiro Ogata; Fuchio Takeda; Akito Yoshimaru, all of Yokohama; Shuichi Endoh; Toshio Kaneko, both of Tokyo; Toshihiko Takaya, Yokohama, all of Japan

[73] Assignee: Ricoh Company, Ltd., Tokyo, Japan

[21] Appl. No.: 851,503

[22] Filed: Apr. 14, 1986

[30] Foreign Application Priority Data

Apr. 15, 1985 [JP] Japan ..... 60-78525
Apr. 17, 1985 [JP] Japan ..... 60-80275

[51] Int. Cl.[4] ..... G03G 15/08

[52] U.S. Cl. ..... 355/3 DD; 355/3 R; 355/14 D

[58] Field of Search ..... 355/3 R, 3 DD, 14 D; 118/651, 652, 661

[56] References Cited

U.S. PATENT DOCUMENTS

| | | | |
|---|---|---|---|
| 4,378,158 | 3/1983 | Kanbe | 355/3 DD |
| 4,564,285 | 1/1986 | Yasuda et al. | 355/14 D X |
| 4,669,852 | 6/1987 | Tajima et al. | 355/3 DD |

FOREIGN PATENT DOCUMENTS

| | | | |
|---|---|---|---|
| 55-33174 | 3/1980 | Japan | 118/661 |
| 56-91261 | 7/1981 | Japan | 355/14 D |
| 57-115574 | 7/1982 | Japan | 355/3 DD |
| 58-223158 | 12/1983 | Japan | 355/3 DD |
| 59-126567 | 7/1984 | Japan | 355/3 DD |
| 60-80875 | 5/1985 | Japan | 355/3 DD |
| 60-80876 | 5/1985 | Japan | 355/3 DD |
| 60-103375 | 6/1985 | Japan | 355/3 DD |
| 60-103370 | 6/1985 | Japan | 355/3 DD |
| 2163371A | 2/1986 | United Kingdom | 355/3 DD |

*Primary Examiner*—A. C. Prescott
*Assistant Examiner*—Jane Lau
*Attorney, Agent, or Firm*—Cooper & Dunham

[57] ABSTRACT

A developing device includes a developing sleeve driven to rotate for transporting a film of charged developer as carried thereon past a developing station where the film of developer is applied to an electrostatic latent image to have it developed. Also provided is a sponge roller pressed against and driven to rotate in the same rotating direction as that of the developing sleeve, so that the developer is supplied to the developing sleeve at one side of the contact between the developing sleeve and the sponge roller and any residual developer on the developing sleeve is removed at the other side of the contact. Preferably, a desired voltage difference is established between the developing sleeve and the sponge roller. Furthermore, the sponge roller is preferably so structured to have a sufficient conductivity level at least at its outer peripheral surface thereby allowing the residual charge on the developing sleeve to be discharged sufficiently.

12 Claims, 5 Drawing Sheets

THIN FILM DEVELOPING DEVICE

BACKGROUND OF THE INVENTION

1. Field of the Invention

This invention generally relates to a device for developing an electrostatic latent image formed on an image bearing member, and, in particular, to a dry type developing device for developing an electrostatic latent image by applying a thin film of developer thereto. More specifically, the present invention relates to a developing device suitable for use in an imaging machine, such as an electrophotographic copier or facsimile machine.

2. Description of the Prior Art

In electrophotograph and electrostatic recording technology, an electrostatic latent image is formed on an image bearing member and it is developed into a visible image using a developing device. Such development can be carried out by application of a developer to the latent image. The developing device is called wet type when coloring particles, or often called toner, are dispersed in liquid; whereas, it is called dry type when the developer is comprised only of toner. In the dry type developing device, use is typically made of a developing sleeve, on which a thin film of toner electrically charged to a predetermined polarity is formed, for applying the toner to an electrostatic latent image.

The prior art dry type developing devices may be divided into two categories: first category using a two-component developer and second category using a mono-component developer. The two-component developer used in the first category includes a mixture of toner and carrier particles, wherein the toner particles are electrically attracted to the carrier particles, which are comprised of a magnetic material, such as iron, and thus are magnetically attracted to the peripheral surface of a developing sleeve due to a magnetic field created by magnets disposed inside of the developing sleeve. The developing devices of the second category using a mono-component developer were developed as improvements over the developing devices of the first category, and the mono-component developer includes only toner particles which are electrically and magnetically attractable. That is, the toner particles of the mono-component developer include a magnetic material as different from the toner particles of the two-component developer.

Thus, any of the prior art dry type developing device requires a developer to be magnetically attractable because of the reliance on a magnetic force for attraction of the developer onto the developing sleeve. In the case of the two-component developer, the carrier particles are magnetically attracted to the developing sleeve and the toner particles are electrically attracted to the carrier particles, and the toner particles are electrostatically transferred to the image bearing member selectively in accordance with the charge pattern of an electrostatic latent image formed on the image bearing member. On the other hand, in the case of the mono-component developer, since the toner particles themselves include a magnetic material, the toner particles are magnetically attracted to the peripheral surface of the developing sleeve and then they are selectively transferred to the image bearing member according to an electrostatic force acting between the toner particles and an electrostatic latent image formed on the image bearing member. Because of the necessity to create a magnetic field, one or more magnets must be disposed inside of the developing sleeve, which tends to make the developing sleeves large in size. Besides, the provision of magnets inside of the developing sleeve presents some difficulty in manufacture, in particular in an assembling process. Therefore, there has still been a need to develope an improved device for developing an electrostatic latent image.

SUMMARY OF THE INVENTION

It is therefore a primary object of the present invention to obviate the disadvantages of the prior art as described above and to provide an improved device for developing an electrostatic latent image.

Another object of the present invention is to provide an improved developing device capable of using any toner particle which is magnetically attractable or magnetically non-attractable.

A further object of the present invention is to provide an improved dry type developing device capable of forming a developed image high in quality.

A still further object of the present invention is to provide an improved developing device capable of preventing a so-called phantom image from being formed.

A still further object of the present invention is to provide an improved developing device capable of providing a developed image high in quality at all times.

A still further object of the present invention is to provide an improved developing device small in structure and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
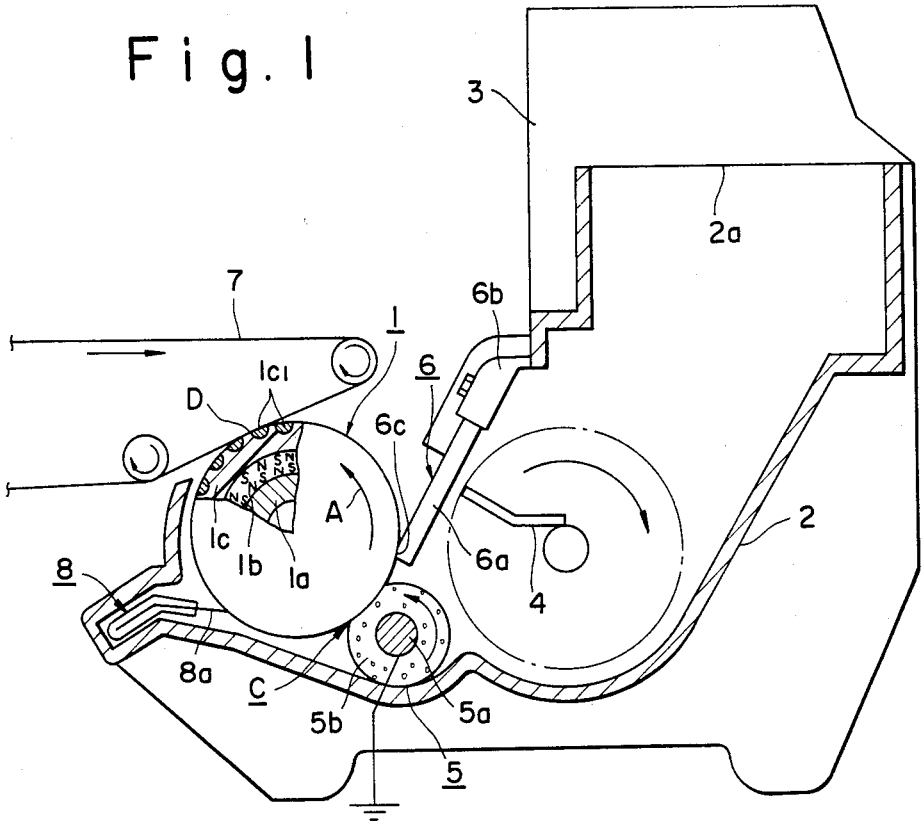
FIG. 1 is a schematic illustration showing a developing device constructed in accordance with one embodiment of the present invention.

Referring now to FIG. 1, there is schematically shown a developing device constructed in accordance with one embodiment of the present invention as applied to the case of using electrically and magnetically attractable toner particles as a developer. As shown, the developing device includes a developing sleeve 1 which serves as a developer carrier for transporting the developer carried thereon along a predetermined path, or a circular path defined by the peripheral surface of the developing sleeve 1 in this case, and which is rotatably supported and driven to rotate in a direction indicated by the arrow A at constant speed. As more clearly shown in FIG. 2, the developing sleeve 1 in the present embodiment is a composite sleeve which includes an inner sleeve 1*a* of an electrically conductive material, such as aluminum, an intermediate sleeve 1*b*, which is formed on the inner sleeve 1*a* from an elastic material, such as rubber, and magnetized to define a plurality of magnetic poles arranged in the circumferential direction, and an outer sleeve 1*c*, which is formed on the intermediate sleeve 1*b* from a dielectric material with the provision of a plurality of electrode particles as electrically insulated from one another.

Figure 2:
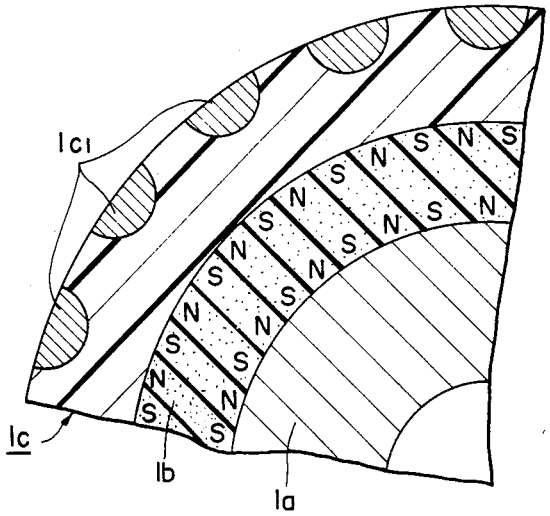
FIG. 2 is a fragmentary, schematic illustration showing on an enlarged scale the detailed structure of the developing sleeve 1 employed in the developing device shown in FIG. 1.

In the case of the composite developing sleeve 1 shown in FIGS. 1 and 2, the intermediate sleeve 1*b* defines a rubber magnet layer so that elasticity is provided in the developing sleeve 1. In addition, the intermediate sleeve 1*b* is magnetized alternately so that the magnetic poles, S and N, appear alternately in the circumferential direction of the sleeve. Since the intermediate sleeve 1*b* is magnetized, when use is made of toner particles including a magnetic material, they may be magnetically attracted to the outermost peripheral surface of the developing sleeve 1. Besides, since the intermediate sleeve 1*b* is magentized, there is no need to provide separates magnets inside of the developing sleeve 1. The outer sleeve 1*c* serves as an electrode layer and it is mainly formed from a dielectric material, such as an epoxy resin, and a plurality of electrode particles $1c_1$ are provided in the dielectric layer as dispersed therein as being electrically insulated from one another. For example, carbon black particles may be used for the electrode particles. In manufacture, electrode particles $1c_1$ may be uniformly mixed with a dielectric material and then such a mixture may be applied to the outer peripheral surface of the intermediate sleeve 1*b* to form the outer sleeve 1*c*. In the preferred embodiment, the electrode particles $1c_1$ are provided to be exposed at least partly at the outermost peripheral surface of the outer sleeve 1*c* as electrically insulated from one another. It is to be noted that the electrode particles $1c_1$ may also be comprised of a metal, such as copper.

Other than an epoxy resin, the dielectric material for forming the outer sleeve 1*c* may be selected from various materials, including acrylic family, urethane family, styrene family, acrylic-urethane family, epoxy-silicone family, and epoxy-teflon family. It is to be noted, however, that the selection of a dielectric material for the outer sleeve 1*c* is preferably made such that there is a larger gap in triboelectric series between the dielectric material of the outer sleeve 1*c* and the material of the toner particles used, so that the toner particles may be charged to a predetermined polarity efficiently. With the provision of the electrode layer or outer sleeve 1*c* having the structure described above, even if use is made of a mono-component developer, the density of a developed image for a line original image is selectively increased due to the so-called edge effect provided by the electrode particles $1c_1$ of the outer sleeve 1*c*, which allows to obtain a developed image of high quality at all times. Moreover, if use is made of a low resistance material, such as carbon black, for the electrode particles $1c_1$, since it normally has a tendency to attract the toner particles as compared with a metal, such a structure is more preferable when use is made of non-magnetic, mono-component toner particles.

As also shown in FIG. 1, the present developing device further includes a hopper 2 for storing therein a quantity of a developer. Although the present invention should not be limited only thereto, the developer used in the present embodiment is a mono-component developer comprised of electrically and magnetically attractable toner particles. At the top of the hopper 2 is defined a replenishing opening 2*a*, where a developer cartridge 3 filled with a developer may be detachably mounted for replenishing the developer into the hopper 2. In the illustrated embodient, after mounting the cartridge 3 in position, the cartridge 3 is opened, for example, by removing a cover film (not shown), thereby causing the developer filled in the cartridge 3 to drop into the hopper 2 under the influence of gravity. Inside of the hopper 2 is disposed a rotating agitator 4 which prevents the developer inside of the hopper 2 from forming clumps and also transports the developer inside of the hopper 2 generally toward the developing sleeve 1.

Also provided in the developing device of FIG. 1 as located generally between the developing sleeve 1 and the agitator 4 is a pressure roller 5 comprised of an electrically conductive, elastic material. As will become clear later, a supply port is defined at the bottom left of the hopper 2 when viewing into FIG. 1, and the pressure roller 5 is located at this supply port as rotatably supported and driven to rotate in the direction indicated by the arrow at constant speed. It should also be noted that the pressure roller 5 is positioned to be in rolling contact under pressure with the developing sleeve 1. In the preferred embodiment, the material forming at least the outer peripheral surface portion of the pressure roller 5, which comes into rolling contact with the outer peripheral surface of the developing sleeve 1, is selected to be separated from the material of the developer in terms of the triboelectric series as much as possible so as to allow to charge the developer efficiently. In the illustrated embodiment, the pressure roller 5 includes a shaft 5*a* and a surface layer 5*b* which is formed on the shaft 5*a* from a mixture of polyurethane foam rubber and electrically conductive carbon particles.

The pressure roller 5 may be driven to rotate in any desired direction, but it is preferably driven to rotate in the direction at that of the developing sleeve 1, or counterclockwise in the illustrated embodiment. Described more in detail in this respect, when the developing sleeve 1 and the pressure roller 5 are driven to rotate in the same direction in contact at C under pressure, those portions of the sleeve 1 and the roller 5 which are in contact at C move in opposite directions as being pressed against each other, thereby providing a scrubbing action therebetween. Thus, as the pressure roller 5 rotates, the developer supplied thereto from the hopper 2 is brought into the contact point C, where the developer is subjected to a scrubbing action between the two oppositely moving portions of the developing sleeve 1 and the pressure roller 5 which are in contact under pressure, so that the developer becomes charged to a predetermined polarity efficiently and a layer of the thus charged developer is formed as attracted to the peripheral surface of the developing sleeve 1.

It is to be noted that the pressure roller 5 is connected to ground in the embodiment shown in FIG. 1. Thus, as will be described more fully later, even if a residual developer, which has not been used at a developing station D, is present on the outer peripheral surface of the developing sleeve 1, when the residual developer comes into contact with the pressure roller 5 through the rotation of the developing sleeve 1, the residual developer is discharged and also removed from the developing sleeve 1 by the pressure roller 5.

Downstream of the pressure roller 5 with respect to the direction of rotation thereof is disposed a doctor blade 6 for regulating the thickness of the developer carried on the developing sleeve as attracted thereto, thereby forming a thin film of developer charged to a predetermined polarity and having a desired thickness on the outer peripheral surface of the developing sleeve 1. Preferably, the doctor blade 6 is comprised of a magnetic material at least partly and plate-shaped extending across the width of the developing sleeve 1. As an alternative structure, a separate magnetic material may be fixedly attached to the doctor blade 6. The doctor blade 6 has its proximal end fixedly supported by a holder **6*b*, which, in turn, is fixedly attached to a wall of the hopper 2. A free end portion 6*a* of the doctor blade 6 is pressed against the outer peripheral surface of the developing sleeve 1. In the preferred embodiment, the doctor blade 6 is comprised of a magnetic material at least partly and a magnetic field is formed at the outer peripheral surface of the developing sleeve 1 as emanating from the rubber magnet layer 1*b*, so that the free end portion 6*a* of the doctor blade 6 is magnetically attracted toward and thus pressed against the outer peripheral surface of the developing sleeve 1. It is to be noted that the holder 6*b* may be so provided that the free end portion 6*a* of the doctor blade 6 is pressed against the developing sleeve 1 when the doctor blade 6** is mounted in position.

In the embodiment illustrated in FIG. 1, the doctor blade 6 is oriented in a so-called counter direction, i.e., the free end portion **6*a* of the doctor blade 6 being pointed in the direction opposite to the direction of movement of that portion of the developing sleeve 1 which is in pressure contact with the free end portion 6*a*. It should be noted, however, that the doctor blade 6 may also be oriented in a so-called trailing direction, i.e., the free end portion 6*a* of the doctor blade 6 being pointed in the same direction as that of movement of that portion of the developing sleeve 1 which is pressure contact with the free end portion 6*a*. In either orientation, the doctor blade 6 is preferably so disposed with its forward edge 6*c* in contact with the outer peripheral surface of the developing sleeve 1. Thus, the free edge 6*c* of the doctor blade 6 is in contact with the outer peripheral surface of the developing sleeve 1 across a predetermined width of the developing sleeve 1, so that a thin film of developer extending across the predetermined width is formed on the developing sleeve 1 by the doctor blade 6**.

At an appropriate location downstream of the doctor blade 6 with respect to the direction of rotation of the developing sleeve 1 is disposed an endless organic photoconductive (OPC) belt 7, which serves as an image bearing member and is extended around a plurality of rollers, at least one of which is driven to rotate so as to cause the endless belt 7 to travel in the direction indicated by the arrow. The imaging belt 7 is in rolling contact with the developing sleeve 1 at a developing station D, where those portions of the belt 7 and the sleeve 1 which are in contact move in the same direction. It is to be noted that the outer surface of the imaging belt 7 defines an imaging surface on which a latent image to be developed is formed and developed by the developing sleeve 1 at the developing station D. That is, typically, the imaging surface of the belt 7 is first uniformly charged to a predetermined polarity, for example, by a corona charger (not shown), and the thus charged imaging surface is exposed to an orginal image thereby causing the uniform charge on the imaging surface to be selectively dissipated in accordance with a light pattern of the original image to form an electrostatic latent image. And, this electrostatic latent image is brought to the developing station D as the belt travels. On the other hand, since a thin film of charged developer is formed on the outer peripheral surface of the developing sleeve 1, the developer is selectively transferred to the imaging surface of the belt 7 in accordance the electrostatic latent image thereby developing the latent image to define a visible developed image on the belt 7. As the belt 7 further travels, the developed image is normally transferred to a sheet of paper and then fixed thereto.

The developing device shown in FIG. 1 also includes a charge-removing brush assembly 8 as disposed downstream of the developing station D with respect to the direction of rotation of the developing sleeve 1 for removing undesired charge from the outer peripheral surface of the developing sleeve 1 and/or from the developer remaining on the developing sleeve 1. The outer peripheral surface of the developing sleeve 1 tends to become charged due to friction with the pressure roller 5, doctor blade 6, and OPC belt 7. In addition, when the charged developer carried on the float electrodes $1c_1$ of the developing sleeve 1 are used for developing an electrostatic latent image at the developing station D, counter charge remains in the float electrodes $1c_1$. If there is any residual charge at the outer peripheral surface of the developing sleeve 1, it could cause background contamination or formation of a phantom image, and, thus, it is necessary to remove any undesired residual charge from the outer peripheral surface of the developing sleeve 1. In the present embodiment, the charge-removing brush assembly 8 includes an electrically conductive brush **8*a* which extends in a trailing direction with respect to the direction of rotation of the developing sleeve 1 and which has its free end located to be lightly pressed against the outer peripheral surface of the developing sleeve 1 by its own flexibility. It is to be noted that the free end of the brush 8*a* is in sliding contact with the developing sleeve 1** over a predetermined width.

As the developing sleeve 1 further rotates, the developer remaining on the developing sleeve 1 after the developing step comes to be transported to the position where the pressure roller 5 is disposed, where the residual developer is removed from the developing sleeve 1 by the pressure roller 5. As described before, the pressure roller 5 has the elastic surface layer **5*b* which is pressed against the developing sleeve 1, so that the surface layer 5*b* is slightly deformed to define a surface contact between the developing sleeve 1 and the pressure roller 5. Thus, the residual developer on the developing sleeve 1 may be assuredly removed by the sweeping action of the pressure roller 5. As also described before, the pressure roller 5 is connected to ground, so that, if the residual developer retains any charge, it is discharged when brought into contact with the pressure roller 5 and then removed by the sweeping action of the pressure roller 5. In this manner, the residual developer is first discharged and then physically removed from the developing sleeve in the present embodiment, so that the residual developer may be removed from the developing sleeve 1 with ease and completeness and the level of contact pressure between the developing sleeve 1 and the pressure roller 5 may be set relatively low, which is advantageous from the viewpoint of power consumption and service life. In the illustrated embodiment, the rotation of the pressure roller 5 causes the thus removed developer to be transported back into the hopper 2, and, thus, it is mixed with the developer inside of the hopper 2** for reuse.

As described above, in accordance with the present embodiment, any developer remaining on the developing sleeve 1 after the developing step can be removed from the developing sleeve 1 easily and reliably, so that no phantom image is formed due to residual developer. In addition, the removal of residual developer can be carried out optimally without increasing the level of contact pressure between the developing sleeve 1 and the pressure roller 5 and/or the rotational speed of the pressure roller 5, there is no need to increase the driving torque of the developing sleeve and there is no possibility of causing scattering of developer. It should be noted that the surface layer **5*b* of the pressure roller 5** may also be comprised of a non-porous elastic material, such as rubber or metal.

Figure 3:
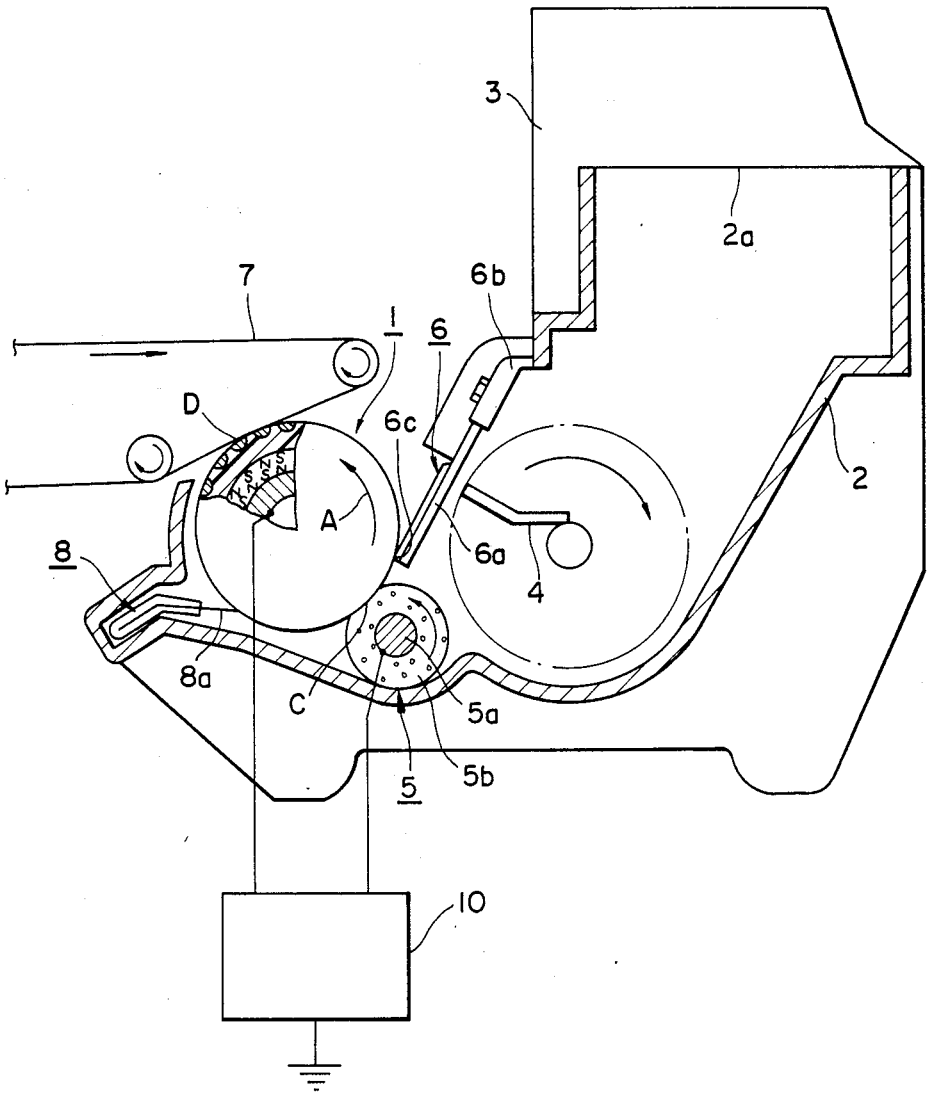
FIG. 3 is a schematic illustration showing a developing device constructed in accordance with another embodiment of the present invention.

Referring now to FIG. 3, there is schematically shown a developing device constructed in accordance with another embodiment of the present invention. Since the developing device of this embodiment is similar in many respects to the previously described embodiment, like numerals are used for like elements. As shown in FIG. 3, the developing device of this embodiment further includes a voltage applying unit 10 which is connected to the developing sleeve 1 and also to the pressure roller 5 to apply respective voltages thereto so as to establish a predetermined voltage difference between the developing sleeve 1 and the pressure roller 5. Denoting the voltage applied to the developing sleeve 1 by Vb and the voltage applied to the pressure roller 5 by Vsp, the quality of developed images has been found to vary as a function of (Vsp−Vb) as will be described more in detail below. In the following description regarding the developing characteristic as a function of (Vsp−Vb), it will be assumed that the developer is positively charged and positive-to-positive development is carried out.

Figure 4:
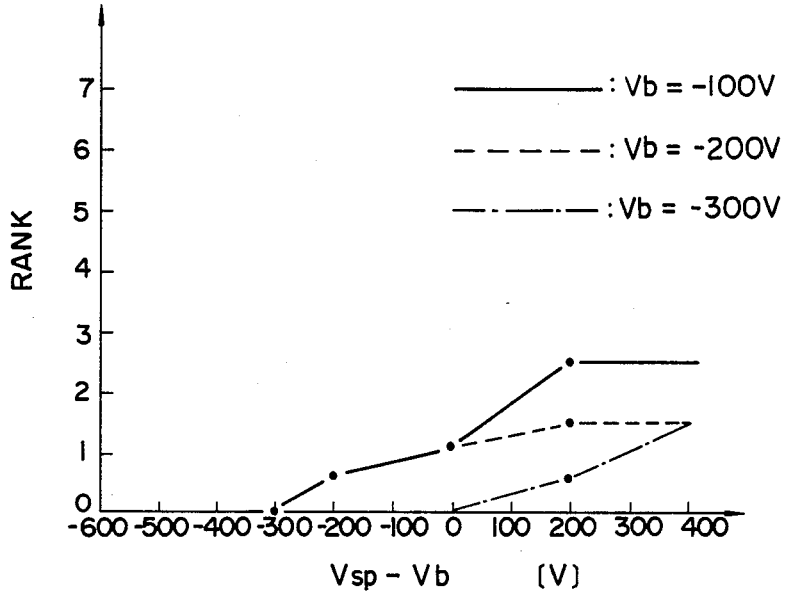
FIGS. 4 through 7 are graphs which are useful for explaining the advantages obtainable in the developing device shown in FIG. 3.
Figure 5:
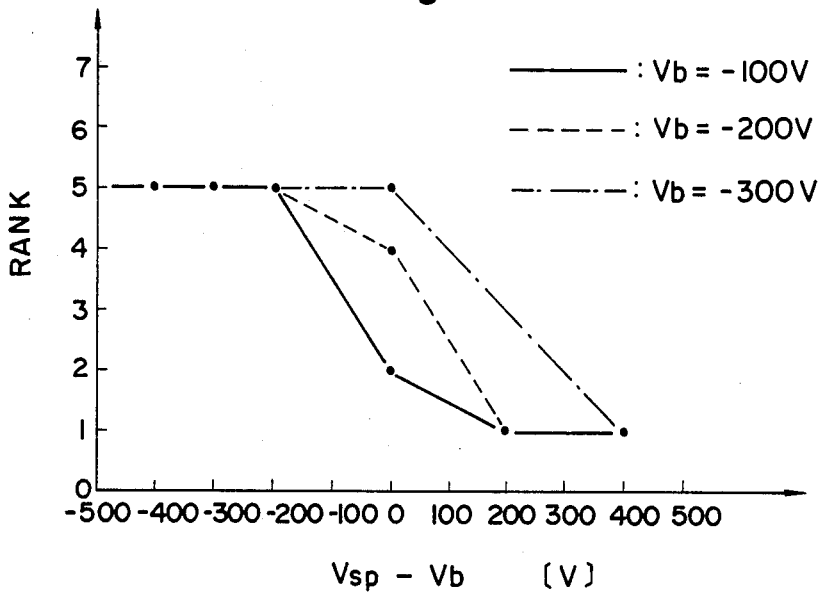
Figure 6:
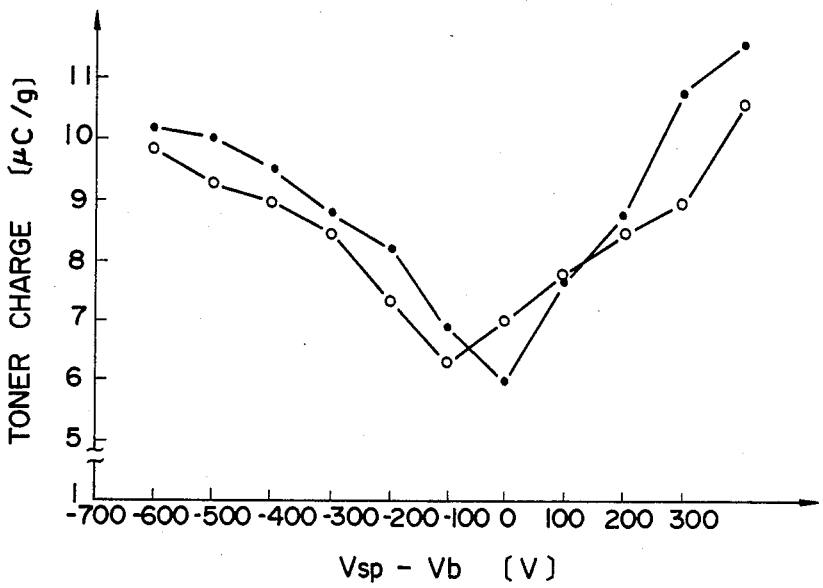
Figure 7:
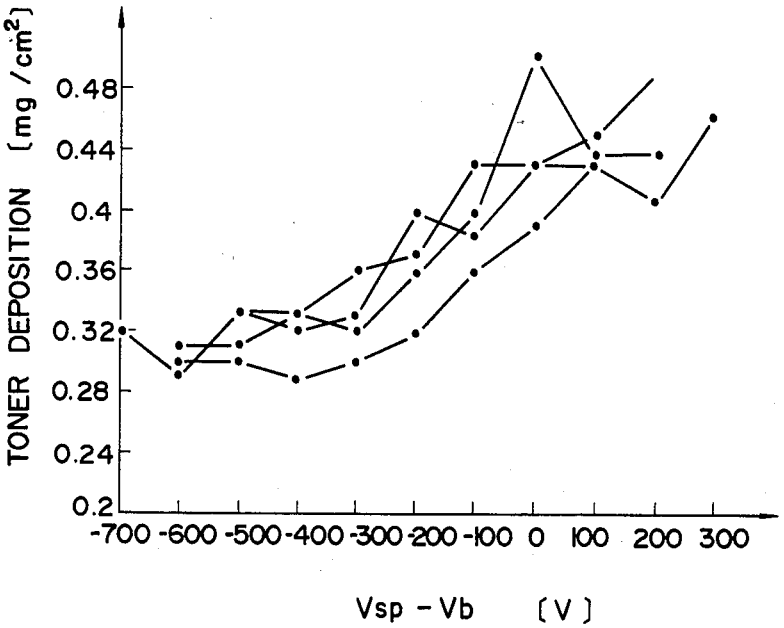

FIG. 4 graphically shows the relation between the degree of occurrence of phantom image and the voltage difference (Vsp−Vb). It may be seen that the degree of occurrence of phantom image is less in a region where the voltage difference (Vsp−Vb) is negative. Moreover, for the same voltage difference (Vsp−Vb), the degree of occurrence of phantom image is less if Vb is set smaller. FIG. 5 graphically shows the relation between the degree of background contamination and the voltage difference (Vsp−Vb), according to which, it may be seen that rank 5, indicating the absence of background contamination, is obtained when the voltage difference (Vsp−Vb) is negative in value. Also in this case, as voltage Vb is set smaller, excellent image quality of rank 5 is obtained over a broader range of (Vsp−Vb). Further, FIGS. 6 and 7 graphically show how the charge-to-mass ratio of the developer and the amount of deposition of developer per unit area of the developing sleeve 1 varies as a function of the voltage difference (Vsp−Vb), respectively. As may be seen from FIG. 6, the ratio becomes a minimum when the voltage difference (Vsp−Vb)=0 and the ratio gradually increases as the absolute value of the voltage difference (Vsp−Vb) increases. On the other hand, as understood from FIG. 7, the amount of deposition of developer gradually increases as the voltage difference (Vsp−Vb) increases in a positive sense.

From the above finding, it can be said that the voltage difference (Vsp−Vb) should be set in a negative value in order to improve the image quality with respect to phantom image and background contamination and the voltage difference (Vsp−Vb) should be set in a positive value so as to increase the image density. Thus, depending on a desired quality of a developed image, the voltage difference (Vsp −Vb) should be set appropriately. Thus, it is preferable to provide the voltage applying unit 10 as connected to the developing sleeve 1 and the pressure roller 5 because the voltage of each of the developing sleeve 1 and the pressure roller 5 may be set varingly depending on a desired image quality.

It is to be noted that although use is made of a magnetic, mono-component developer for each of the above-described embodiments, use may also be made of a non-magnetic, mono-component developer, if desired. In addition, the image bearing member 7 may be replaced by a photoconductive drum.

Figure 8:
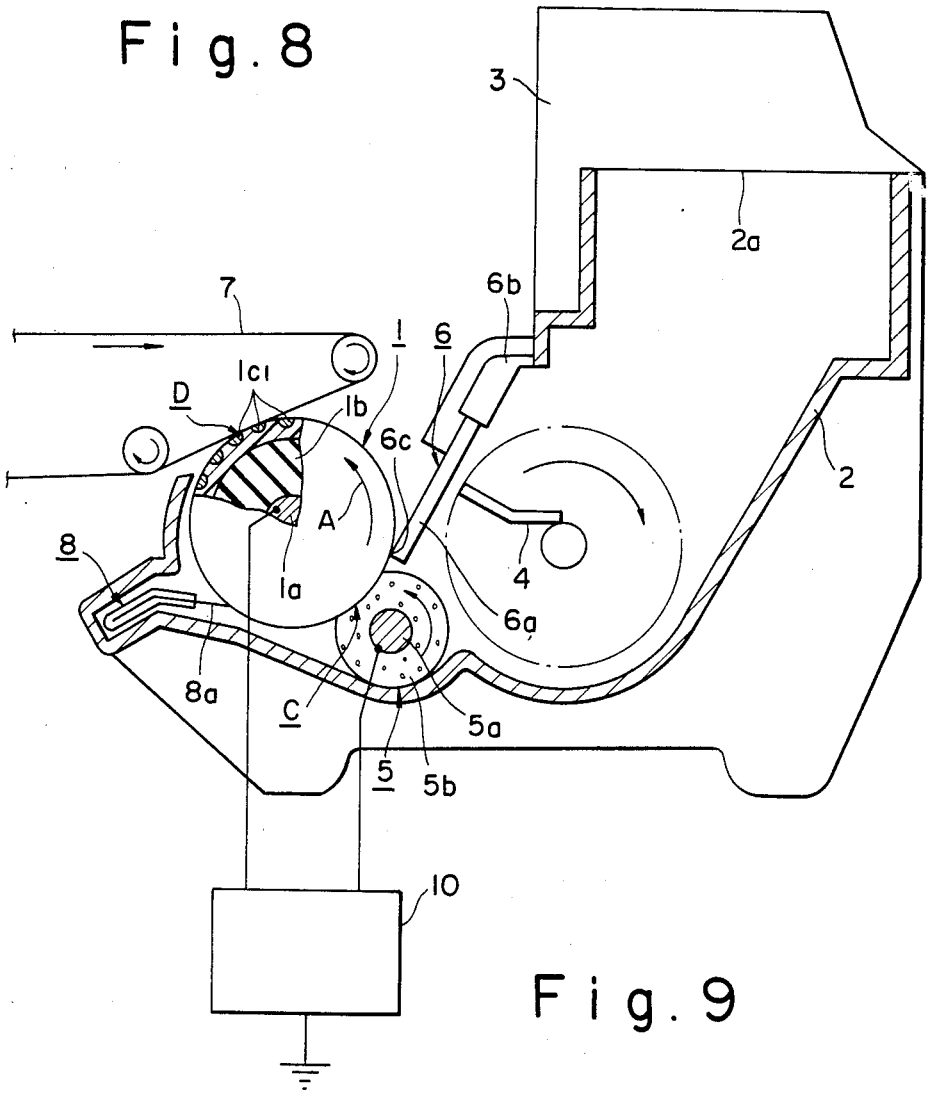
FIG. 8. is a schematic illustration showing a developing device constructed in accordance with a further embodiment of the present invention.
Figure 9:
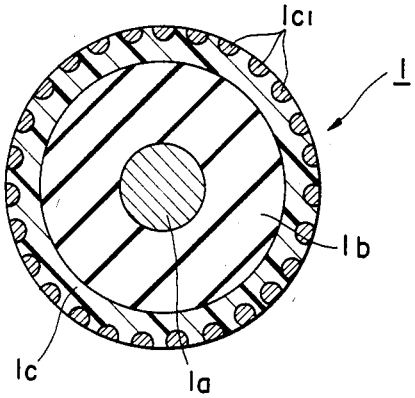
FIG. 9 is a schematic, cross-sectional view showing on an enlarged scale the developing sleeve employed in the developing device shown in FIG. 8.

FIG. 8 schematically shows a developing device constructed in accordance with a further embodiment of the present invention. Since this embodiment is also similar in structure in many respects to the previously described embodiments, in principle, like elements are indicated by like numerals. It is to be noted, however, that the developing device shown in FIG. 8 has been constructed as applied for use with a non-magnetic, mono-component developer. Thus, as different from the previously described embodiments, the rubber layer **1*b* is not magnetized. In addition, the inner sleeve 1*a* of each of the previously described embodiments is substituted by a rotary shaft 1*a* in the present embodiment. On the other hand, the electrode layer 1*c*** remains virtually unchanged.

In the present embodiment shown in FIG. 8, the pressure roller 5 is so structured that the material forming the surface layer **5*b* has a resistivity of $10^8$ ohms-cm or less. Since the surface layer 5*b* of the pressure roller 5 of the present embodiment has a sufficient level of conductivity, the residual developer remaining on the developing sleeve 1 can be discharged sufficiently when it comes into contact with the surface layer 5*b* of the pressure roller 5. The fact that the residual developer is sufficiently discharged momentarily indicates that the residual developer can be removed from the developing sleeve 1 by the pressure roller 5 effectively with ease. Moreover, when the surface layer 5*b* is formed from a porous material, such as foam rubber, if the pore size is relatively large, the developer or toner particles enter the pores so that the pores come to be plugged with the developer; on the other hand, if the pore size is too small, then the frictional force between the developing sleeve 1 and the pressure roller 5 increases, thereby requiring a larger driving torque for the developing sleeve 1. Thus, the average size of the pores of the sponge roller 5 is preferably set in a range between 20 and 500 microns. The pressure or sponge roller 5** is also preferably so manufactured that it does not have any radial projection or ridge at its outer peripheral surface because the presence of such a projection or ridge can be a cause for formation of streaks in the resulting developed image.

It should be noted that although use has been made of a non-magnetic, mono-component developer in the embodiment shown in FIG. 8, use may also be made of a magnetic, mono-component developer. In this case, the rubber layer 1*b* may be magnetized, if desired.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A device for developing an electrostatic latent image by applying a film of developer thereto, comprising:

transporting means for transporting a developer as carried thereon along a predetermined path which includes a developing station where an electrostatic latent image is developed by said developer carried on said transporting means;

storing means for storing a quantity of developer;

a rotary member driven to rotate in a predetermined direction and pressed against said transporting means, wherein said rotary member caused said developer from said storing means to be supplied to said transporting means at a first side of a contact between said rotary member and said transporting means with respect to a direction of movement of said transporting means at said contact and causes any residual developer carried on said transporting means to be removed from said transporting means at a second side of said contact with respect to said direction of movement of said transporting means at said contact; and voltage applying means for applying a first voltage to said transporting means and a second voltge to said rotary member to establish a desired voltage difference between said transporting means and said rotary member facilitating the supply of said developer from said rotary member to said transporting means.

2. The device of claim 1 wherein said rotary member is provided with a layer of an elastic, porous material at least at its surface.

3. The device of claim 2 wherein said layer is electrically conductive and connected to ground.

4. The device of claim 3 wherein said transporting means includes a developing sleeve which is rotatably supported and driven to rotate in the same direction as that of said rotary member.

5. The device of claim 4 wherein said developing sleeve is a composite sleeve including a core, an intermediate sleeve formed on said core, and an outer sleeve formed on said intermediate sleeve, whereby said outer sleeve includes a layer of a dielectric material and a plurality of electrode particles dispersed therein as electrically insulated from one another.

6. The device of claim 5 wherein said core is an inner sleeve or a rotary shaft.

7. The device of claim 5 wherein said intermediate sleeve is comprised of an elastic material.

8. The device of claim 5 wherein said intermediate sleeve is magnetized in a predetermined pattern.

9. The device of claim 1 further comprising regulating means disposed downstream of said rotary member with respect to the direction of movement of said transporting means for regulating the thickness of said developer supplied to said transporting means by said rotary member.

10. The device of claim 9 wherein said regulating means includes a doctor blade having a free end pressed against said transporting means.

11. The device of claim 1 wherein said rotary member is provided with a layer comprised of an elastic, porous material having a resistivity of $10^8$ ohms-cm or less at least at an outer periphery thereof.

12. The device of claim 11 wherein said layer has pores whose average size is in a range between 20 and 500 microns.

* * * * *